US012173478B2

(12) United States Patent
Yamamoto et al.

(10) Patent No.: US 12,173,478 B2
(45) Date of Patent: Dec. 24, 2024

(54) CONTROL SYSTEM FOR WORK MACHINE

(71) Applicant: Hitachi Construction Machinery Co., Ltd., Tokyo (JP)

(72) Inventors: Shinjiro Yamamoto, Ami-machi (JP); Shinya Imura, Toride (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 18/023,910

(22) PCT Filed: Sep. 1, 2020

(86) PCT No.: PCT/JP2020/033130

§ 371 (c)(1),
(2) Date: Feb. 28, 2023

(87) PCT Pub. No.: WO2022/049642

PCT Pub. Date: Mar. 10, 2022

(65) Prior Publication Data

US 2023/0243126 A1 Aug. 3, 2023

(51) Int. Cl.
*E02F 9/24* (2006.01)
*E02F 9/26* (2006.01)

(52) U.S. Cl.
CPC . *E02F 9/24* (2013.01); *E02F 9/26* (2013.01)

(58) Field of Classification Search
CPC ..... E02F 9/24; E02F 9/26; E02F 9/205; E02F 9/265; E02F 9/2025; B60Y 2200/412
See application file for complete search history.

(56) References Cited

U.S. PATENT DOCUMENTS 7,149,530 B1 12/2006 Arakawa et al.
2004/0148083 A1* 7/2004 Arakawa ..... G07C 5/085 701/50

(Continued)

FOREIGN PATENT DOCUMENTS

JP 3839669 B2 11/2006
JP 2011000905 A * 1/2011

(Continued)

OTHER PUBLICATIONS

Translation of JP2011000905A—Jan. 6, 2011 (Year: 2011).*

(Continued)

*Primary Examiner* — Paul N Dickson
*Assistant Examiner* — Shams Dhanani
(74) *Attorney, Agent, or Firm* — Crowell & Moring LLP

(57) ABSTRACT

Provided is a control system for a work machine that allows a worker in the operation around the work machine to safely approach the work machine. The control system for a work machine includes: a work machine 1 including a work implement 7, a lock mechanism 14 for the work implement 7, a lock controller 13 that controls the lock mechanism 14, and a communication device 20; and a communication terminal 30 that is able to communicate with the communication device 20 of the work machine 1. The lock controller 13 controls the lock mechanism 14 so as not to be released from a locked state in a case receiving a lock demand signal from the communication terminal 30, and controls the lock mechanism 14 so as to be released from the locked state in a case receiving a lock demand cancellation signal from the communication terminal 30.

5 Claims, 11 Drawing Sheets

(56) References Cited

U.S. PATENT DOCUMENTS

| | | | | |
|---|---|---|---|---|
| 2008/0150677 | A1 | 6/2008 | Arakawa | |
| 2023/0082533 | A1* | 3/2023 | Kim | E05B 77/54 701/1 |
| 2023/0123942 | A1* | 4/2023 | Tago | H04N 5/265 345/632 |
| 2023/0366178 | A1* | 11/2023 | Saitoh | E02F 9/16 |

FOREIGN PATENT DOCUMENTS

| | | | |
|---|---|---|---|
| JP | 2012-73913 | A | 4/2012 |
| JP | 2017-82430 | A | 5/2017 |
| JP | 2017-203253 | A | 11/2017 |
| WO | WO 2006/075562 | A1 | 7/2006 |

OTHER PUBLICATIONS

International Search Report (PCT/ISA/210) issued in PCT Application No. PCT/JP2020/033130 dated Nov. 24, 2020 with English translation (five (5) pages).

Japanese-language Written Opinion (PCT/ISA/237) issued in PCT Application No. PCT/JP2020/033130 dated Nov. 24, 2020 (four (4) pages).

* cited by examiner

CONTROL SYSTEM FOR WORK MACHINE

TECHNICAL FIELD

The present invention relates to a control system for a work machine that allows a worker in the operation around the work machine to safely approach the work machine.

BACKGROUND ART

There is known a system that detects an approaching worker and forcibly stops a work machine in order to prevent the worker from coming into contact with the work machine. For example, a method for detecting a distance to an obstacle using electromagnetic waves or a stereo camera and a method for detecting a moving body by analyzing images from a camera are used to detect an obstacle, control a work implement based on the detected information, and decelerate and stop the work implement, so as to prevent a worker from coming into contact with a work machine. Unfortunately, such a method for detecting an obstacle may not be able to detect an obstacle depending on environment, and thus it is difficult to avoid an accident completely. Then, as a method for surely notifying the presence of a worker, there is known a method for transmitting information from a terminal that the worker itself possesses and making control based on the information. According to the system described in Patent Literature 1, identification information of an entering person entering a worksite is transmitted from a communication machine provided for the entering person, and a work machine can be locked according to the identification information of the entering person and a distance between the work machine and the entering person calculated from a signal intensity, and thus the safety management can surely be performed.

CITATION LIST

Patent Literature

Patent Literature 1: JP 2017-82430 A

SUMMARY OF INVENTION

Technical Problem

The above conventional technique has the following issues since determination of whether to lock the work machine is made based on only the identification information and the distance between the work machine and the entering person. The conventional technique does not consider whether or not the entering person's intent is to stop the work machine and does not clearly show what distance to the work machine will cause the work machine to be locked. This may lead to unnecessary locking of the work machine. In addition, since the work machine may be locked at a time when an operator of the work machine does not intend to lock it, a secondary damage may occur. Furthermore, when the entering person needs to approach the work machine, the entering person cannot safely approach the work machine because the entering person is not able to surely grasp whether the work machine is being locked or when the work machine will be unlocked.

The present invention has been made in view of the foregoing, and provides a control system for a work machine that allows a worker in the operation around the work machine to safely approach the work machine.

Solution to Problem

To solve the above issues, the control system for a work machine of the present invention is a control system for a work machine including: a work machine including a work unit, a lock mechanism that locks the work unit to disable operation thereof, a lock controller that controls the lock mechanism, and a communication device; and a communication terminal that is able to communicate with the communication device of the work machine. The lock controller controls the lock mechanism so as not to be released from a locked state in a case receiving a lock demand signal for demanding a locked state of the lock mechanism from the communication terminal, and controls the lock mechanism so as to be released from the locked state in a case receiving a lock demand cancellation signal for canceling the lock demand signal for the lock mechanism from the communication terminal.

Advantageous Effects of Invention

According to the present invention, a worker can send its intention to lock the work machine to disable the movement of the work machine when the worker wishes to approach the work machine, and the worker can confirm that the work machine will definitely not move, thus allowing the worker to safely approach the work machine.

Other issues, configurations, and advantageous effects will become apparent from the following description of embodiments.

DESCRIPTION OF EMBODIMENTS

Figure 1:
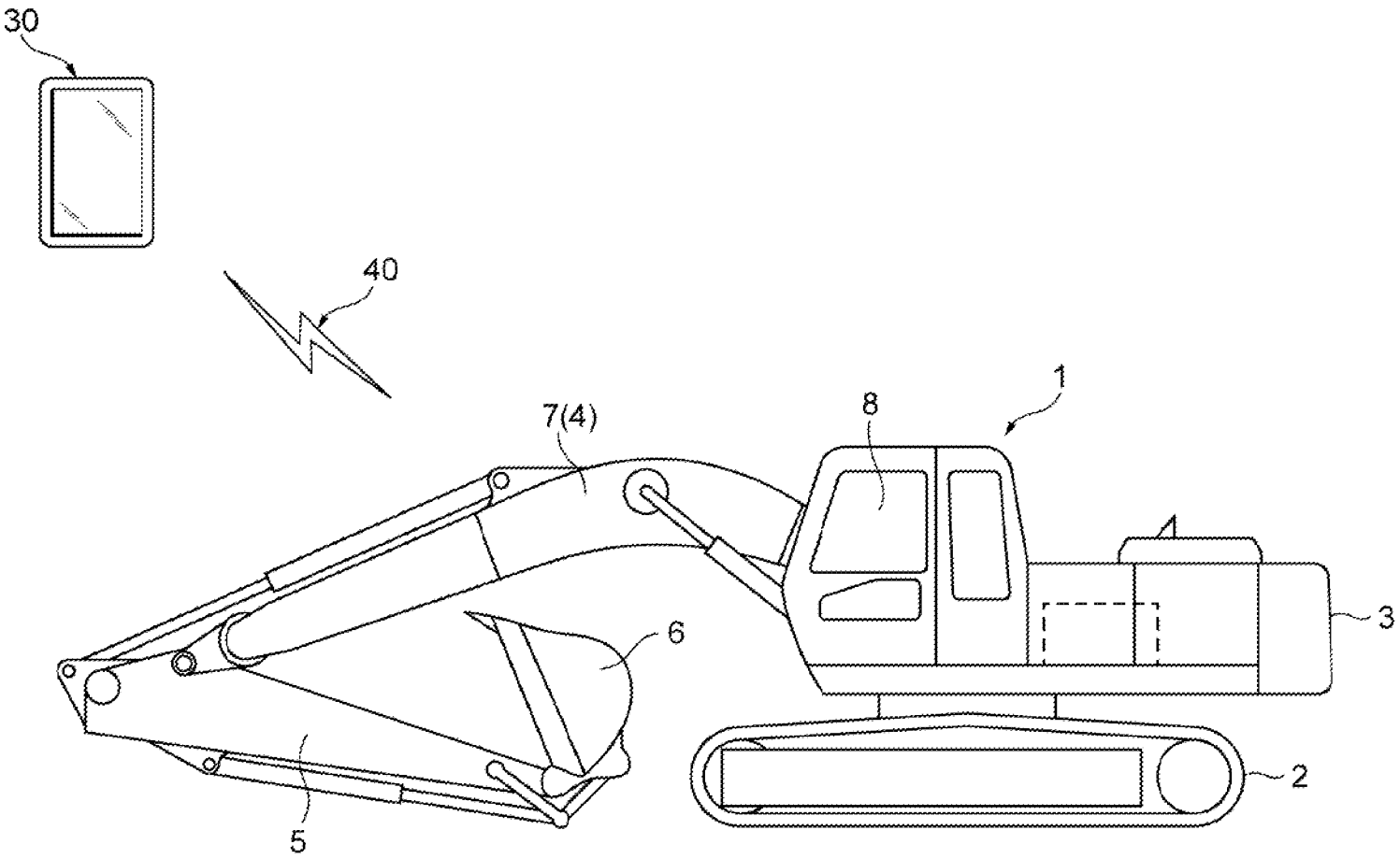
FIG. 1 is an external view of a control system for a work machine according to a first embodiment.

The following describes embodiments of the present invention with reference to the drawings. In each drawing, the same reference numeral is given to a part having the same function and the repeated description is omitted in some cases. The present embodiment exemplifies a work machine by way of a hydraulic excavator. However, the work machine is not limited to a hydraulic excavator, and is applicable to general work machines such as wheel loaders, cranes, bulldozers, dumps, and road machines, as long as it can lock (decelerate and stop) a work implement performing various works, a turning body performing a turning operation, and a traveling body performing a traveling operation to disable operations thereof and can unlock the same.

First Embodiment

A first embodiment of a control system for a work machine of the present invention will be described with reference to FIG. 1 to FIG. 4.

FIG. 1 is an external view of a control system for a work machine according to the first embodiment of the present invention.

The present control system includes a work machine 1 and a communication terminal 30. The work machine 1 includes a lower traveling body 2 that travels by driving a track, for example, and an upper turning body 3 that is turnably mounted on the lower traveling body 2. To the upper turning body 3, a work implement 7 made up of a boom 4, an arm 5, and a bucket 6 for conducting excavation work and the like is attached so as to be able to rotatably move (to be able to vertically move). In addition, the upper turning body 3 is provided with a cab (an operator cab) 8 in which an operator seat for an operator to be seated to operate (actuate) the work implement 7 (or the boom 4, the arm 5, and the bucket 6 thereof) or the like is installed, for example. The work machine 1 is able to communicate with the communication terminal 30 that a worker in the operation around the work machine 1 possesses via a communication network 40.

Figure 2:
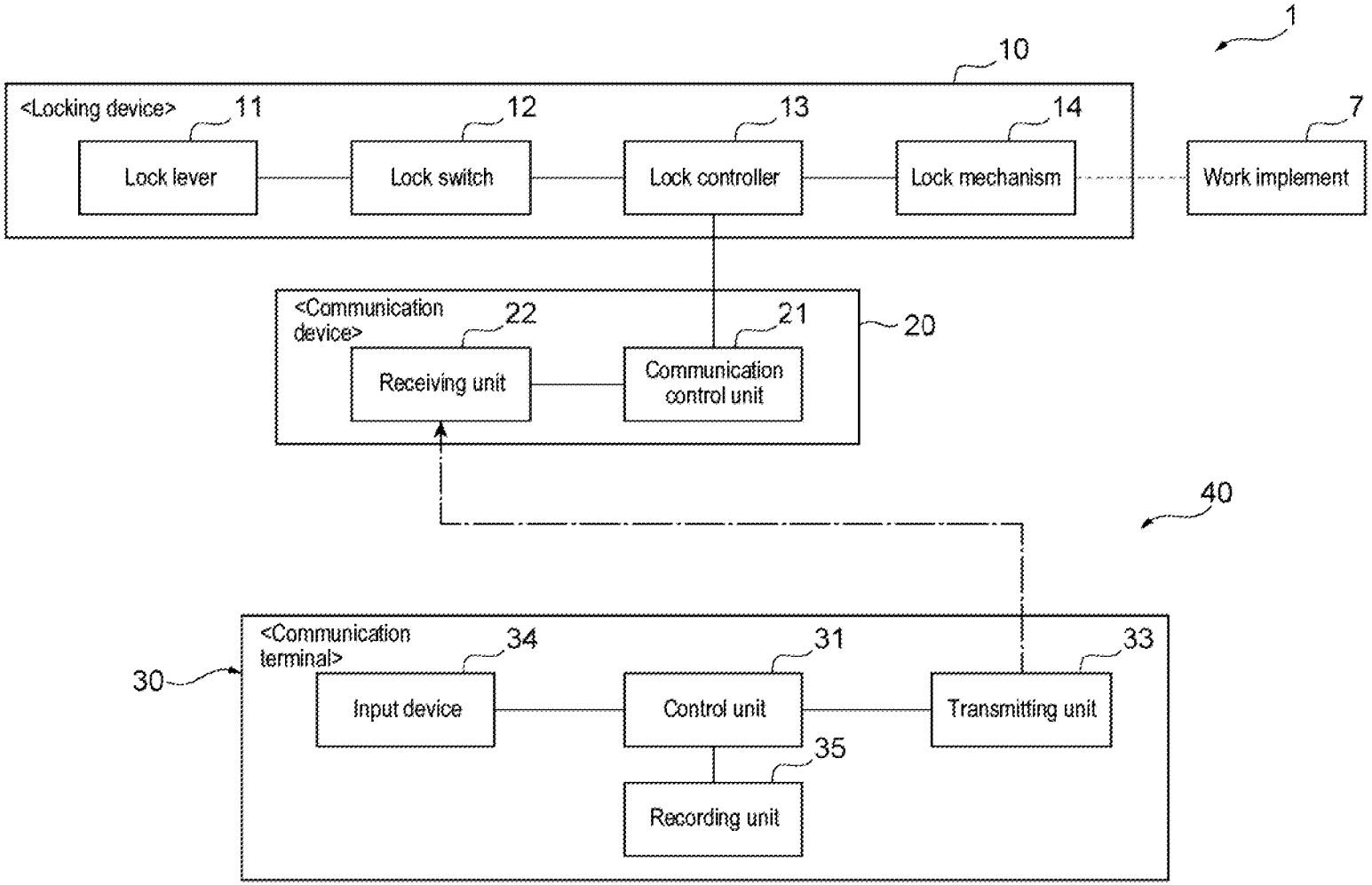
FIG. 2 is a diagram of a major configuration of the control system for a work machine according to the first embodiment.

FIG. 2 is a diagram of a major configuration of the control system for a work machine according to the first embodiment of the present invention.

(Configuration of Work Machine)

The work machine 1 includes a locking device 10 that locks the boom 4, the arm 5, and the bucket 6 of the work implement 7 to disable operations thereof and unlocks the same. The locking device 10 includes a lock lever 11, a lock switch 12, a lock controller 13, and a lock mechanism 14. The lock lever 11 is disposed inside of the cab 8, for example, such that the operator inside of the cab 8 can control. The lock lever 11 is switchably connected to the lock switch 12, and a signal from the lock switch 12 (a signal indicating a state of the lock switch 12) is transmitted to the lock controller 13. Furthermore, the lock controller 13 is configured to be able to drive the lock mechanism 14 for locking the work implement 7 (for disabling or prohibiting the operation of the work implement 7). The lock switch 12 is switched by the operator operating the lock lever 11. The lock controller 13 is able to control the driving state of the lock mechanism 14 based on a signal transmitted from the lock switch 12 (a signal indicating a locked state or unlocked state of the lock switch 12). Upon receiving a signal indicating a locked state from the lock switch 12, the lock controller 13 turns the lock mechanism 14 into a locked state by driving (i.e., by locking) the lock mechanism 14, and upon receiving a signal indicating an unlocked state from the lock switch 12, the lock controller 13 turns the lock mechanism 14 into an unlocked state by not driving (i.e., by unlocking) the lock mechanism 14, such that the driving state of the lock mechanism 14, that is, locking and unlocking of the work implement 7, may be switched.

Specifically, for example, when the work implement 7 is actuated by a hydraulic actuator, the lock mechanism 14 includes a lock valve that stops the supply of a pressure oil to the hydraulic actuator or blocks a control signal of a control valve for controlling the pressure oil supplied to the hydraulic actuator.

The work machine 1 includes a communication device 20 that communicates with the outside via the communication network 40. The communication device 20 includes a communication control unit 21 and a receiving unit 22. The receiving unit 22 can send information received from the outside (herein, a transmitting unit 33 of the communication terminal 30) to the communication control unit 21 via the communication network 40, and the communication control unit 21 can send an instruction (signal) to the lock controller 13 based on the information received from the receiving unit 22.

(Configuration of Communication Terminal)

The communication terminal 30 includes a control unit 31, an input device 34, a transmitting unit 33, and a recording unit 35. The communication terminal 30 can receive various kinds of information inputted by a worker via the input device 34, process the information from the input device 34 at the control unit 31, and communicate the processed information from the transmitting unit 33 to the receiving unit 22 of the communication device 20 via the communication network 40. In addition, the communication terminal 30 includes the recording unit 35 for recording the information processed at the control unit 31. The information inputted via the input device 34 and transmitted from the transmitting unit 33 of the communication terminal 30 to the receiving unit 22 of the communication device 20 (received at the receiving unit 22 of the communication device 20) via the communication network 40 includes a lock demand signal (hereinafter this may simply be referred to as a lock demand) for demanding locking of the lock mechanism 14 (turning the lock mechanism 14 into a locked state) and a lock demand cancellation signal (hereinafter this may simply be referred to as a lock demand cancellation) for cancelling the lock demand for the lock mechanism 14 (turning the lock demand into a canceled state or withdrawing the lock demand).

Though not shown, the above-described lock controller 13 and control unit 31 are configured as a microcomputer including a CPU (Central Processing Unit) that executes various operations, a storage unit such as a ROM (Read Only Memory), a HDD (Hard Disk Drive), or the like that stores programs for executing the operations by the CPU, a RAM (Random Access Memory) serving as a work area when the CPU executes the programs, and the like. The CPU loads various programs stored in the storage unit into the RAM and executes the programs so that the functions of the lock controller 13 and the control unit 31 are implemented.

It should be noted that the recording unit 35 may be omitted by use of this storage unit.

(Control Flow of Lock Controller)

Figure 3:
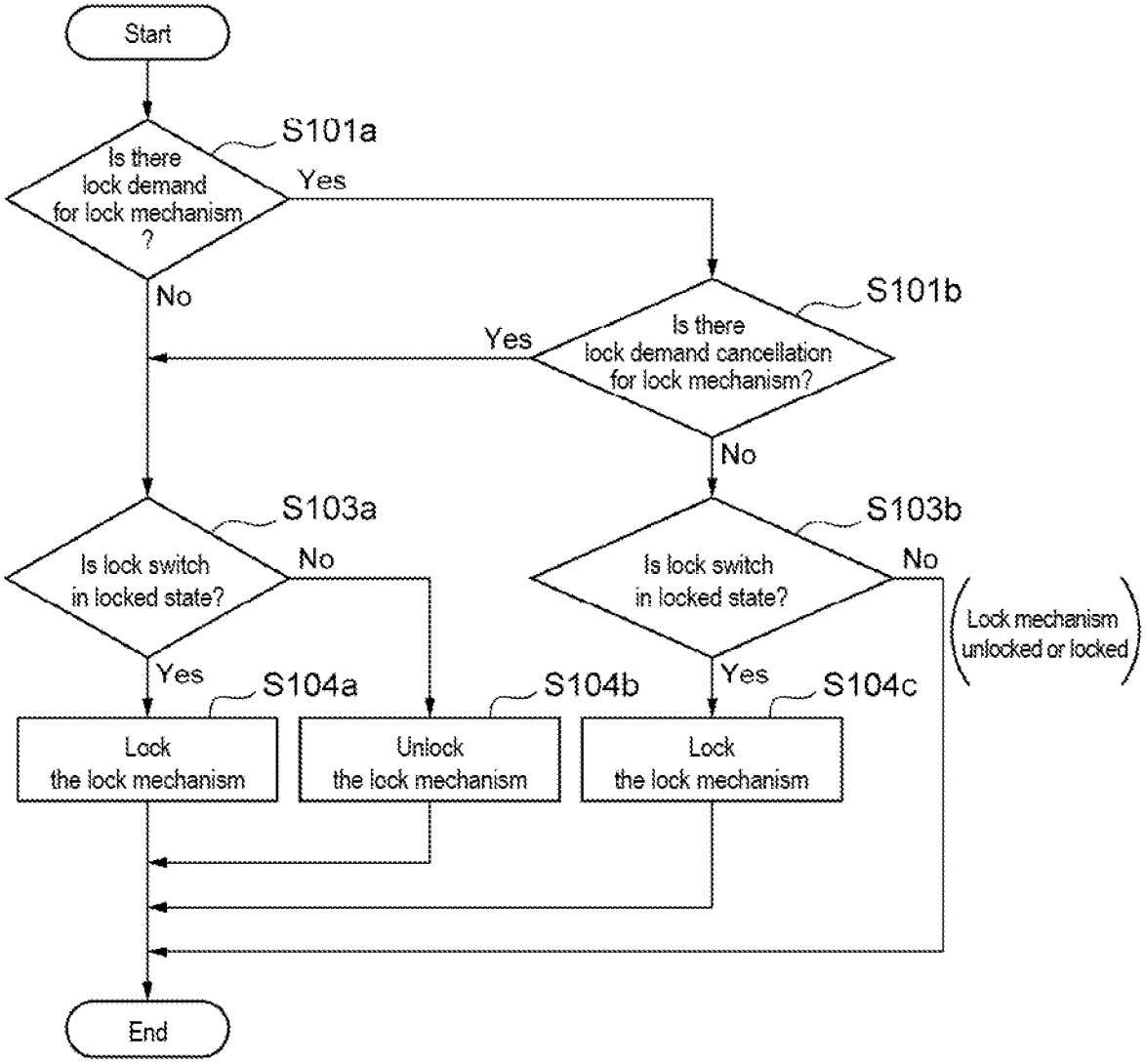
FIG. 3 is a control flow chart of a lock controller according to the first embodiment.

FIG. 3 is a control flow chart of the lock controller according to the first embodiment of the present invention.

In step S101*a*, it is determined whether there is a lock demand to lock the lock mechanism 14 from the communication terminal 30 (whether a lock demand has been received) (via the communication device 20). If there is no lock demand to lock the lock mechanism 14, the state of the lock switch 12 is determined in step S103*a*. If the lock switch 12 is in a locked state, the lock mechanism 14 is locked in step S104*a*, and if the lock switch 12 is not in a locked state, the lock mechanism 14 is unlocked in step S104*b*.

If there is a lock demand to lock the lock mechanism 14 in step S101*a* (step S101*a*: Yes), in step S101*b*, it is determined whether there is a lock demand cancellation to unlock the lock mechanism 14 from the communication terminal 30 (whether a lock demand cancellation has been received) (via the communication device 20). If there is no lock demand cancellation to unlock the lock mechanism 14 (that is, until a lock demand cancellation to unlock the lock mechanism 14 is received), in step S103*b*, the state of the lock switch 12 is determined. If the lock switch 12 is in a locked state, the lock mechanism 14 is locked in step S104*c*, and if the lock switch 12 is not in a locked state, the process ends.

In this way, when there is a lock demand to lock the lock mechanism 14 from the communication terminal 30, it is possible to turn the lock mechanism 14 into a locked state by the lock lever 11. However, once the lock mechanism 14 enters a locked state, even if the lock switch 12 is no longer in the locked state by the lock lever 11 for example (step S103*b*: No), it is now impossible to release the locked state of the lock mechanism 14.

It should be noted that when there is a lock demand to lock the lock mechanism 14 from the communication terminal 30, once the lock mechanism 14 enters a locked state, even if the lock switch 12 is no longer in the locked state by the lock lever 11 for example (step S103*b*: No), it is now impossible to release the locked state of the lock mechanism 14. However, in the example shown in FIG. 3, the state of the lock mechanism 14 when this lock switch 12 is not in a locked state (step S103*b*: No) follows the previously set state (the previous state is held). That is, even if the lock switch 12 is no longer in the locked state by the lock lever 11 for example (step S103*b*: No), when the lock mechanism 14 has already been unlocked (that is, in the previous flow), the unlocked state is held, and when the lock mechanism 14 is locked, the locked state is held. That is, in this example, when there is a lock demand to lock the lock mechanism 14 from the communication terminal 30 (until a lock demand cancellation to unlock the lock mechanism 14 is received), it is possible to turn the lock mechanism 14 into a locked state by a manual operation by the operator of the work machine 1. However, once the lock mechanism 14 enters a locked state, it is now impossible to release the locked state of the lock mechanism 14 by the manual operation by the operator of the work machine 1.

If there is a lock demand cancellation to unlock the lock mechanism 14 in step S101*b* (step S101*b*: Yes), the processes in the above-described step S103*a*, S104*a*, and S104*b* are performed.

Consequently, when there is a lock demand cancellation to unlock the lock mechanism 14 from the communication terminal 30, it is possible to release the locked state of the lock mechanism 14 when the lock switch 12 is no longer in the locked state by the lock lever 11 for example (step S103*a*: No).

(Control Flow of Control Unit of Communication Terminal)

Figure 4:
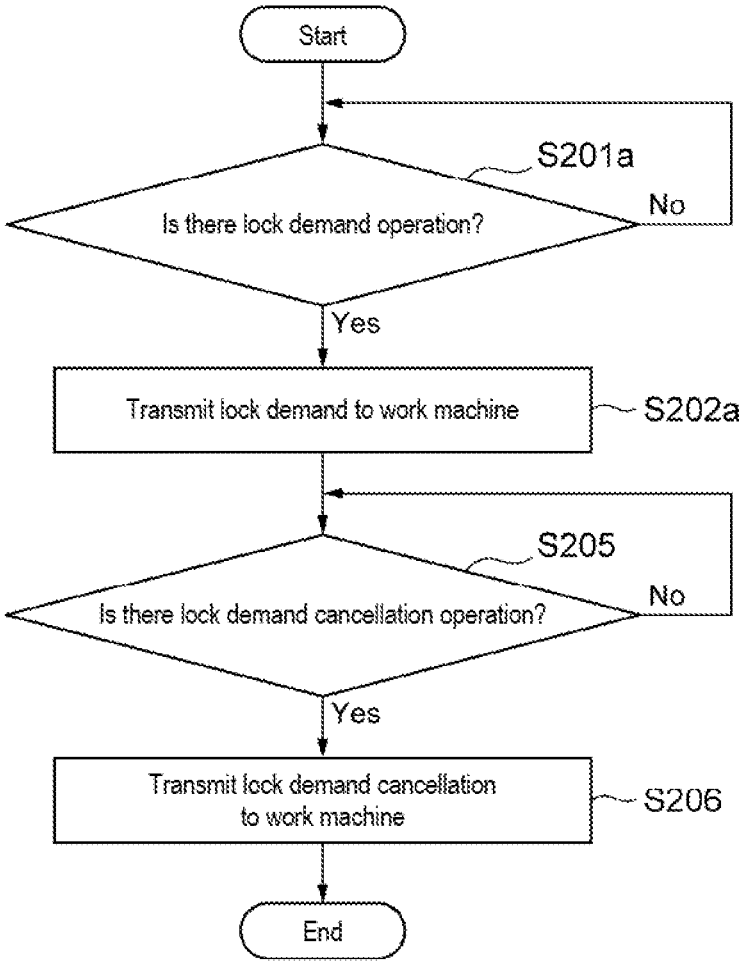
FIG. 4 is a control flow chart of a control unit of a communication terminal according to the first embodiment.

FIG. 4 is a control flow chart of the control unit of the communication terminal according to the first embodiment of the present invention.

In step S201*a*, it is determined whether there is a lock demand operation in the input device 34 (that is, whether there is an input of a lock demand). If there is a lock demand operation, in step S202*a*, a lock demand is transmitted from the transmitting unit 33 to the work machine 1 (or the communication device 20 thereof). In step S205, it is determined whether there is a lock demand cancellation operation in the input device 34 (that is, whether there is an input of a lock demand cancellation). If there is a lock demand cancellation operation, in step S206, a lock demand cancellation is transmitted from the transmitting unit 33 to the work machine 1 (or the communication device 20 thereof).

(Advantageous Effects)

As described above, the control system for a work machine of the first embodiment includes: the work machine 1 including the work implement 7, the lock mechanism 14 that locks the work implement 7 to disable operation thereof, the lock controller 13 that controls the lock mechanism 14, and the communication device 20; and the communication terminal 30 that is able to communicate with the communication device 20 of the work machine 1. The lock controller 13 controls the lock mechanism 14 so as not to be released from a locked state in a case receiving a lock demand signal for demanding the locked state of the lock mechanism 14 from the communication terminal 30, and controls the lock mechanism 14 so as to be released from the locked state in a case receiving a lock demand cancellation signal for canceling the lock demand signal for the lock mechanism 14 from the communication terminal 30.

According to the above-described control system for a work machine of the first embodiment, when there is no lock demand from the communication terminal 30, the lock mechanism 14 is operating in response to the operation of the lock lever 11, whereas when there is a lock demand from the communication terminal 30, it is possible to turn the lock mechanism 14 into a locked state by the lock lever 11, but it is impossible to release the locked state of the lock mechanism 14. Unless the lock demand is canceled from the communication terminal 30 (until there is a lock demand cancellation), it is impossible to release the locked state of the lock mechanism 14, that is, to unlock the work implement 7. This allows the worker to safely approach the work machine 1.

Second Embodiment

A second embodiment of the control system for a work machine of the present invention will be described with reference to FIG. 5 to FIG. 7.

In the following description, the same elements as those of the first embodiment will be denoted by the same reference numerals, and the differences will mainly be described.

Figure 5:
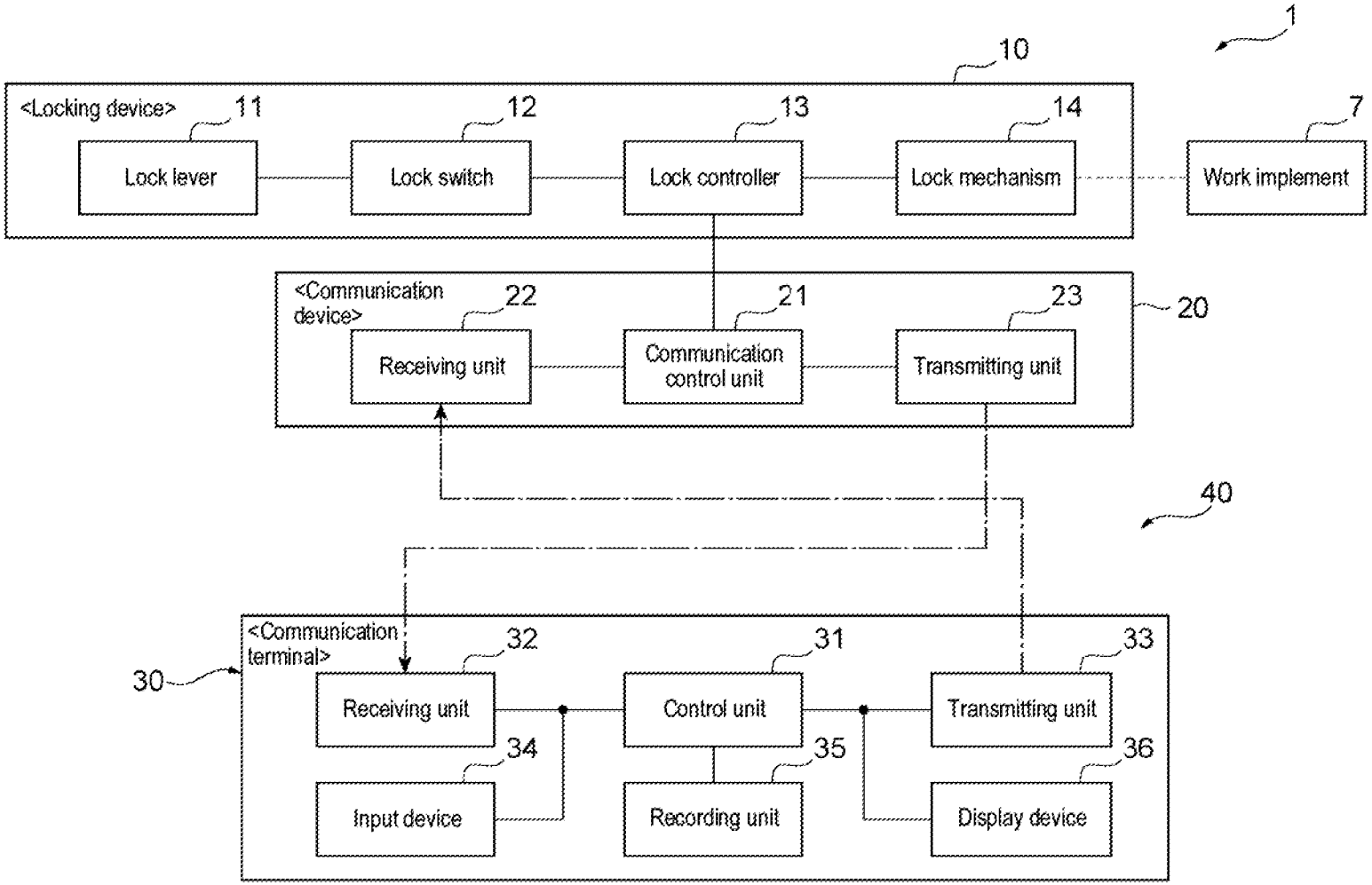
FIG. 5 is a diagram of a major configuration of a control system for a work machine according to a second embodiment.

FIG. 5 is a diagram of a major configuration of the control system for a work machine according to the second embodiment of the present invention.

(Configuration of Work Machine)

In the work machine 1, a transmitting unit 23 is provided in the communication device 20 so as to transmit information on the work machine 1 via the communication network 40.

(Configuration of Communication Terminal Side)

The communication terminal 30 is provided with a receiving unit 32 and a display device 36 so as to receive the information transmitted from the transmitting unit 23 of the communication device 20 at the receiving unit 32 and display the information received at the receiving unit 32 on the display device 36.

(Control Flow of Lock Controller)

Figure 6:
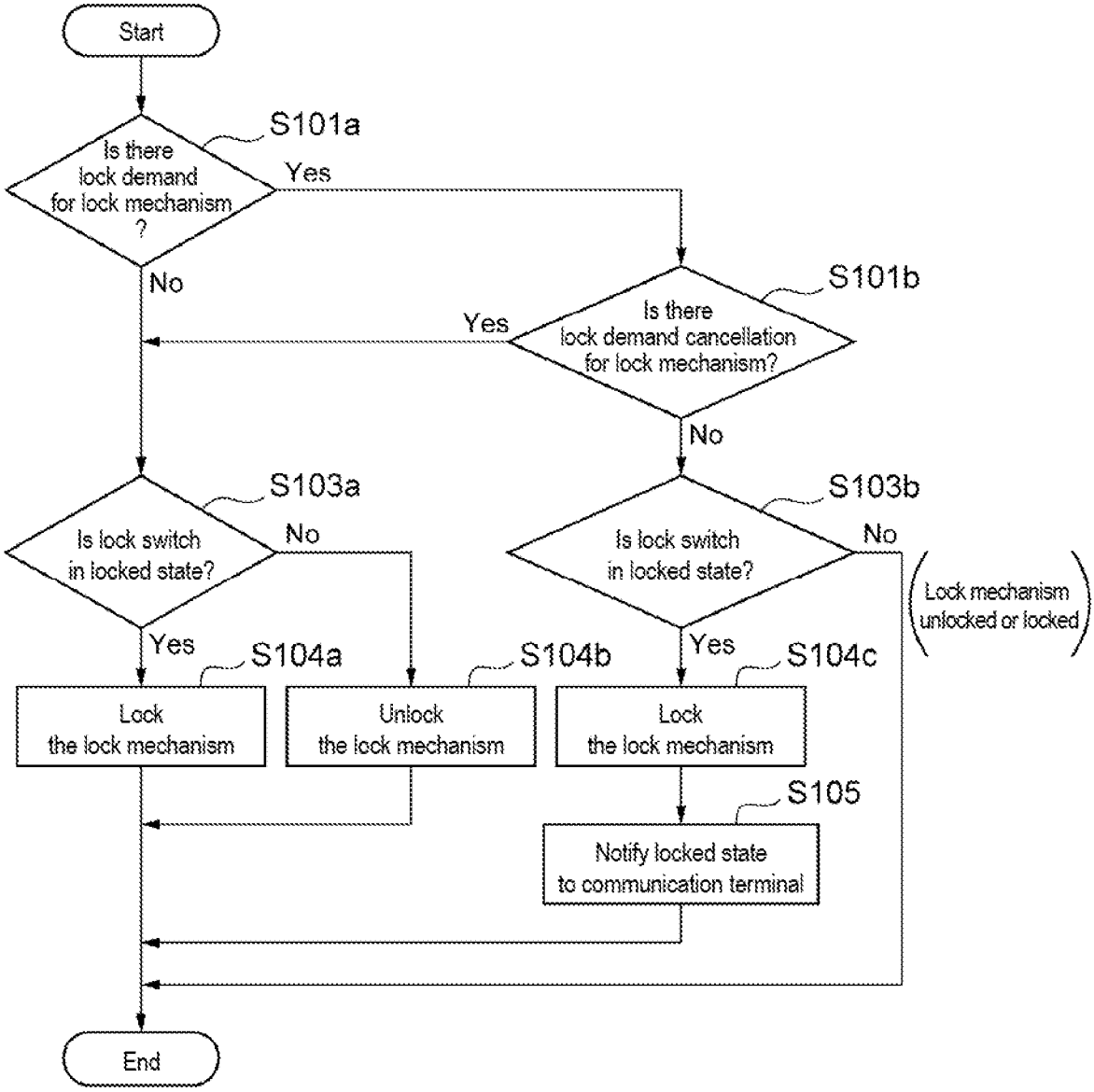
FIG. 6 is a control flow chart of a lock controller according to the second embodiment.

FIG. 6 is a control flow chart of the lock controller according to the second embodiment of the present invention.

When the lock switch 12 is in a locked state in step S103*b* (step S103*b*: Yes) and after the lock mechanism 14 is locked in step S104*c*, in step S105, the locked state of the lock mechanism 14 is notified to the communication terminal (specifically, the communication terminal that has transmitted a lock demand) 30 (or the receiving unit 32 thereof) via the communication device 20 (or the transmitting unit 23 thereof).

(Control Flow of Control Unit of Communication Terminal)

Figure 7:
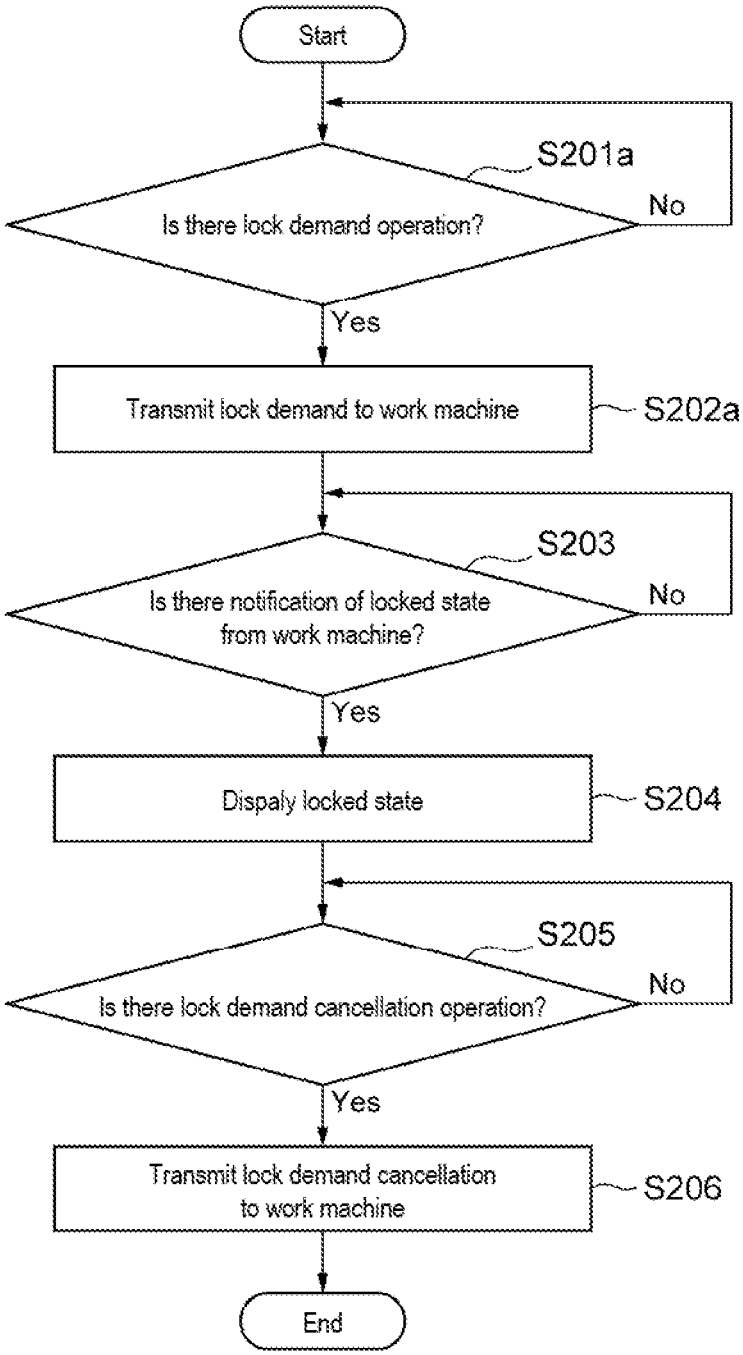
FIG. 7 is a control flow chart of a control unit of a communication terminal according to the second embodiment.

FIG. 7 is a control flow chart of the control unit of the communication terminal according to the second embodiment of the present invention.

In step S203, it is determined whether there is a notification of the locked state of the lock mechanism 14 from the communication device 20 of the work machine 1, and if there is a notification of the locked state of the lock mechanism 14, in step S204, the locked state of the lock mechanism 14 is displayed on the display device 36.

(Advantageous Effects)

As described above, in the control system for a work machine of the second embodiment, when the lock controller 13 receives the lock demand signal from the communication terminal 30 and the lock mechanism 14 is in a locked state, the lock controller 13 notifies the locked state to the communication terminal 30 that has transmitted the lock demand signal via the communication device 20, and the communication terminal 30 includes the display device (notified information display device) 36 that displays the information notified from the lock controller 13.

According to the above-described control system for a work machine of the second embodiment, after a worker makes a lock demand from the communication terminal 30, the worker is notified via the communication device 20 that the lock mechanism 14 has been locked, and thus can easily determine whether the worker may approach the work machine 1.

Third Embodiment

A third embodiment of the control system for a work machine of the present invention will be described with reference to FIG. 8 and FIG. 9.

In the following description, the same elements as those of the second embodiment will be denoted by the same reference numerals, and the differences will mainly be described.

Figure 8:
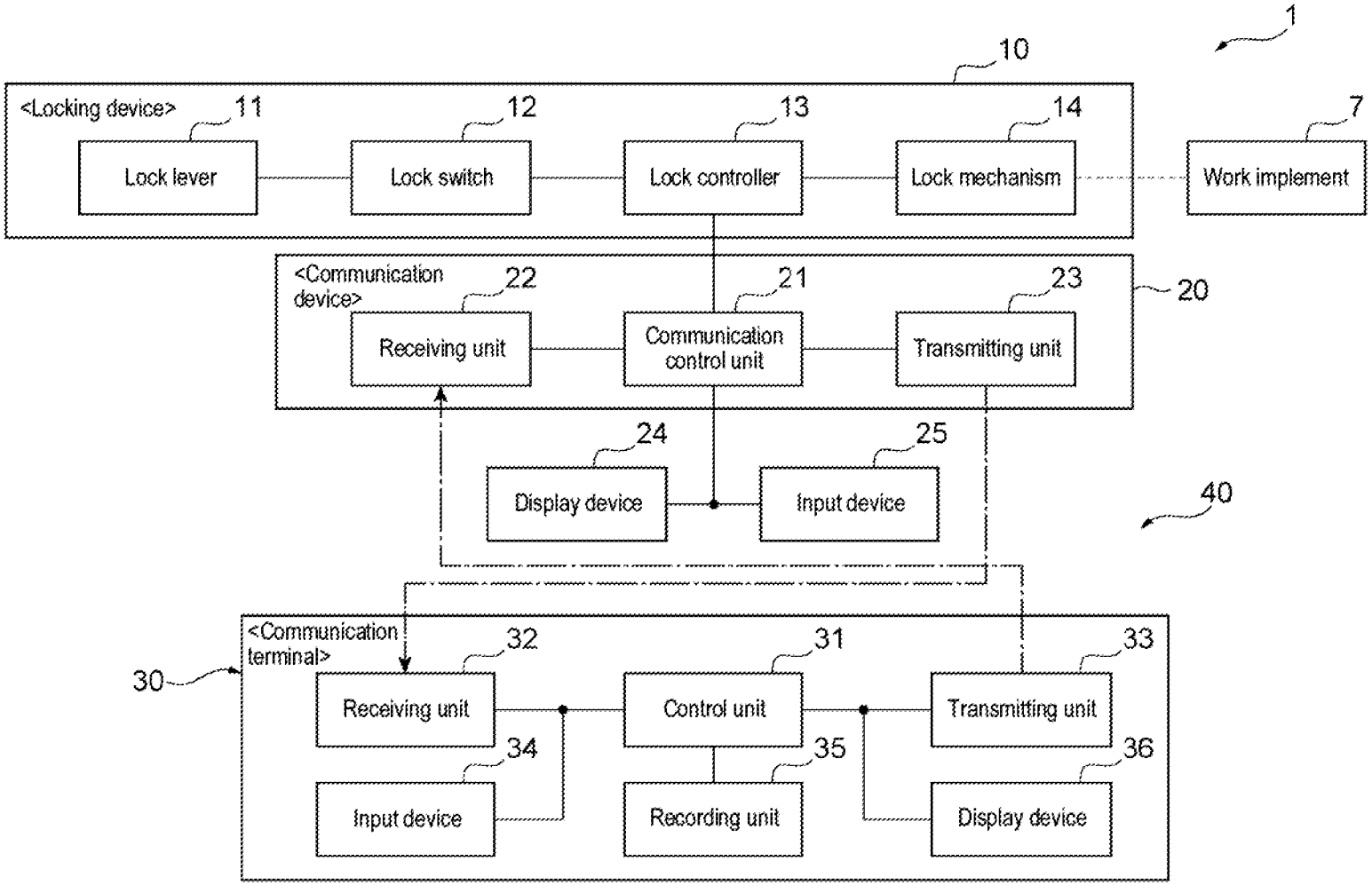
FIG. 8 is a diagram of a major configuration of a control system for a work machine according to a third embodiment.

FIG. 8 is a diagram of a major configuration of the control system for a work machine according to the third embodiment of the present invention.

A display device 24 and an input device 25 are connected to the communication control unit 21 of the communication device 20 such that the information received at the communication control unit 21 is displayed on the display device 24 and the information inputted by the input device 25 is inputted to the communication control unit 21.

The display device 24 and the input device 25 may be provided in the cab 8 or the like of the work machine 1 or may be provided outside of the work machine 1, for example, in a control room or operation room in remote control or the like. In addition, the display device 24 and the input device 25 may be separate components or may be a unitary component.

(Control Flow of Lock Controller)

Figure 9:
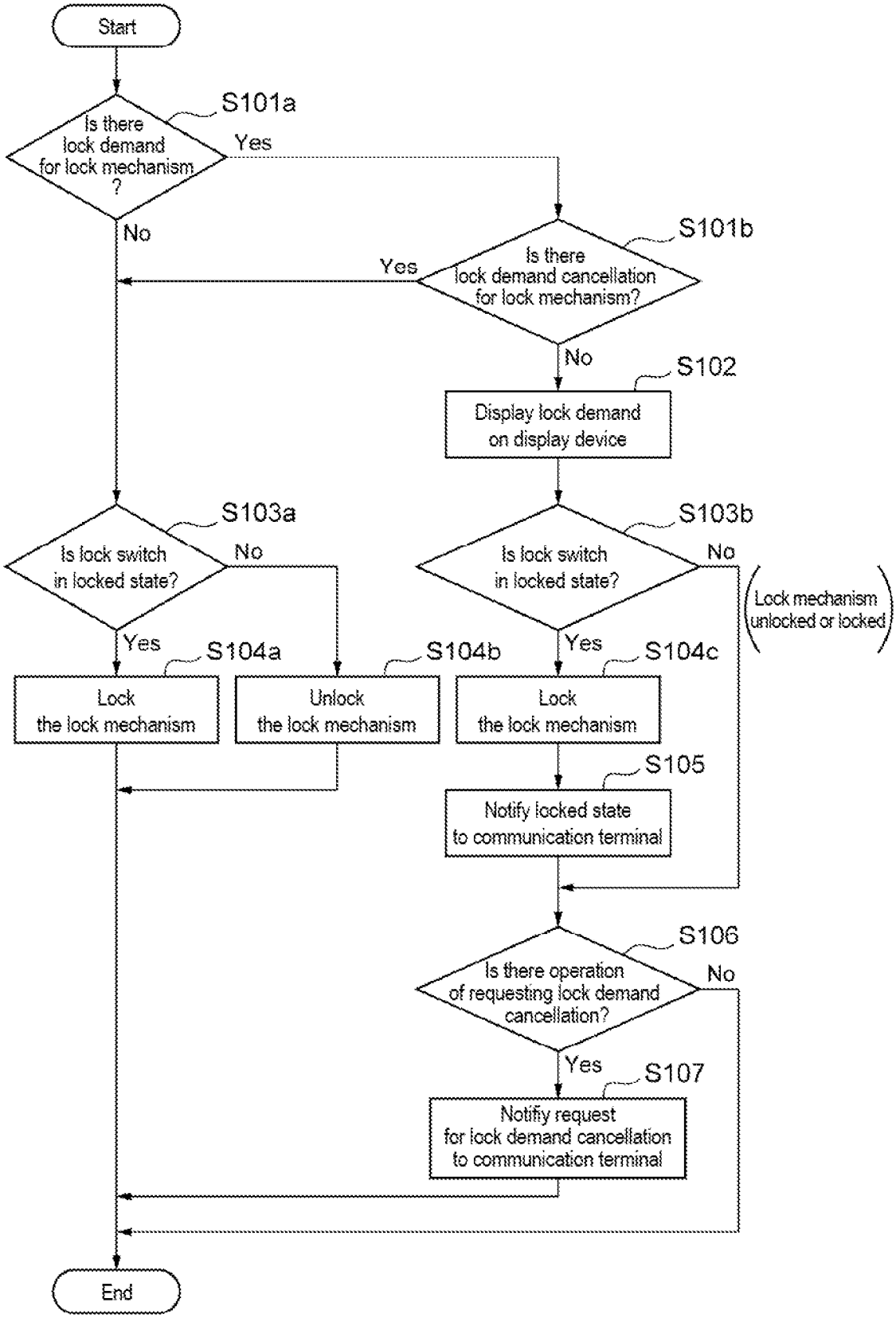
FIG. 9 is a control flow chart of a lock controller according to the third embodiment.

FIG. 9 is a control flow chart of the lock controller according to the third embodiment of the present invention.

If there is a lock demand to lock the lock mechanism 14 in step S101*a* (step S101*a*: Yes) and there is no lock demand cancellation to unlock the lock mechanism 14 in step S101*b* (step S101*b*: No), in step S102, a notification that there is a lock demand to lock the lock mechanism 14 is displayed on the display device 24 via the communication control unit 21. In addition, in step S106, it is determined whether the communication terminal (specifically, the communication terminal that has transmitted a lock demand) 30 is specified using the input device 25 and there is an operation of requesting a lock demand cancellation via the communication control unit 21. If the communication terminal 30 is specified using the input device 25 and the operation of requesting a lock demand cancellation is performed, in step S107, the request for a lock demand cancellation is notified to the communication terminal 30 (the communication terminal 30 that has been specified by the input device 25) (or the receiving unit 32 thereof) from the communication device 20 (or the transmitting unit 23 thereof).

The control unit 31 of the communication terminal 30 determines whether there is a notification of the request for a lock demand cancellation from the communication device 20 of the work machine 1. If there is a notification of the request for a lock demand cancellation, the request for a lock demand cancellation is displayed on the display device 36 (equal to steps S203 and S204 of FIG. 7).

(Advantageous Effects)

As described above, the control system for a work machine of the third embodiment includes the display device (received information display device) 24 that is able to display that the lock demand signal has been received from the communication terminal 30.

In addition, the control system for a work machine of the third embodiment includes the input device 25 that specifies the communication terminal 30 that has transmitted the lock demand signal, and has a function of notifying a request for canceling the lock demand signal to the communication terminal 30 that has been specified by the input device 25.

According to the above-described control system for a work machine of the third embodiment, since a notification that there is a lock demand from the communication terminal 30 is displayed on the display device 24, the operator of the work machine 1 can easily know that there is a worker wishing to approach the work machine 1 and can appropriately lock the lock mechanism 14. In addition, the operator of the work machine 1 can request a lock demand cancellation (notify the request for a lock demand cancellation) when the operator wishes to cancel the lock demand. This allows the operator to appropriately deal with the work machine 1 when the operator intends to move the work machine 1.

Fourth Embodiment

A fourth embodiment of the control system for a work machine of the present invention will be described with reference to FIG. 10 and FIG. 11.

In the following description, the same elements as those of the third embodiment will be denoted by the same reference numerals, and the differences will mainly be described.

Figure 10:
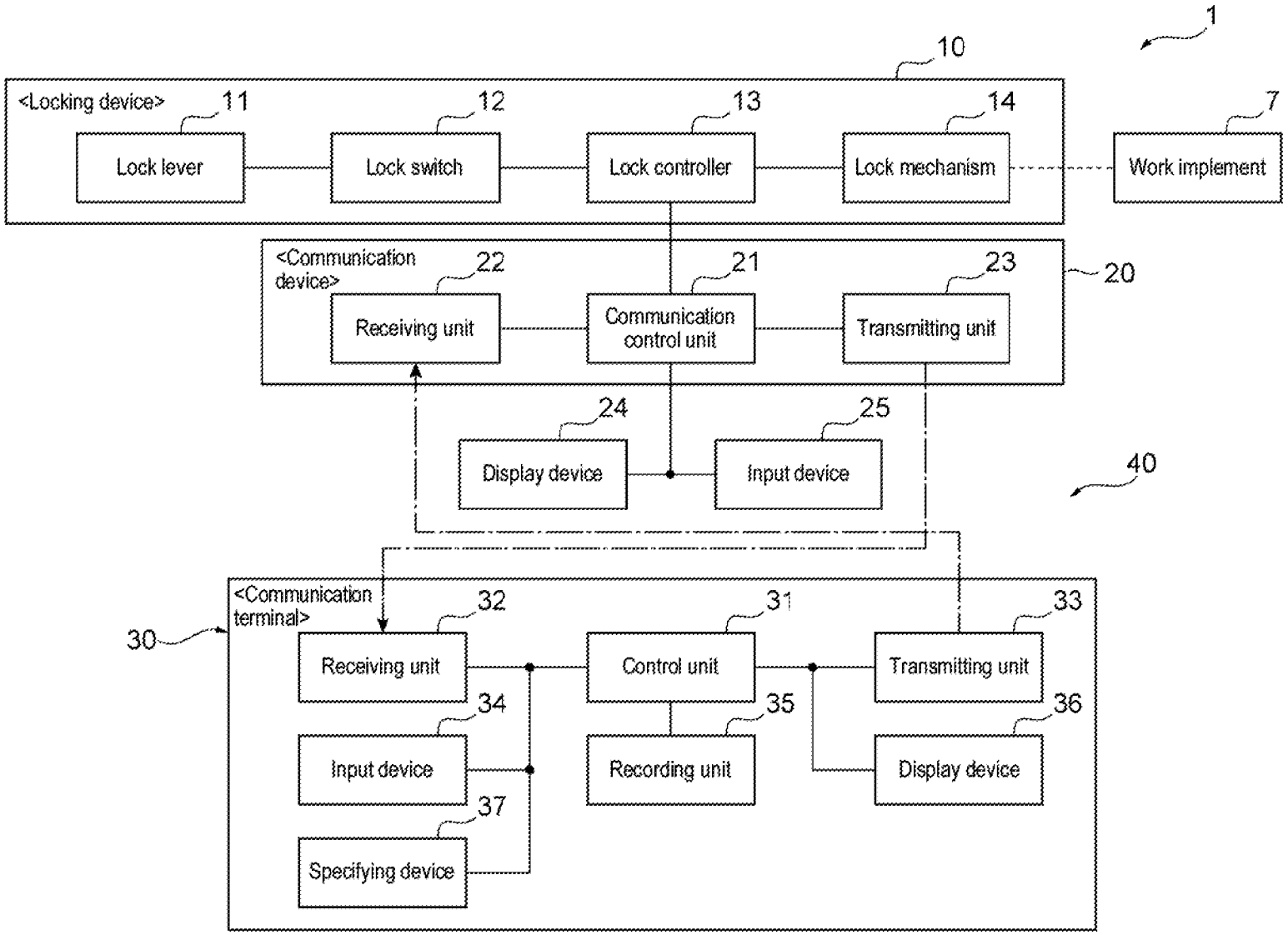
FIG. 10 is a diagram of a major configuration of a control system for a work machine according to a fourth embodiment.

FIG. 10 is a diagram of a major configuration of the control system for a work machine according to the fourth embodiment of the present invention.

(Configuration of Communication Terminal)

A specifying device 37 is connected to the control unit 31 of the communication terminal 30. Using the specifying device 37, it is possible to specify, from a plurality of work machines 1, a work machine 1 to which a lock demand to lock the lock mechanism 14 is transmitted.

(Control Flow of Control Unit of Communication Terminal)

Figure 11:
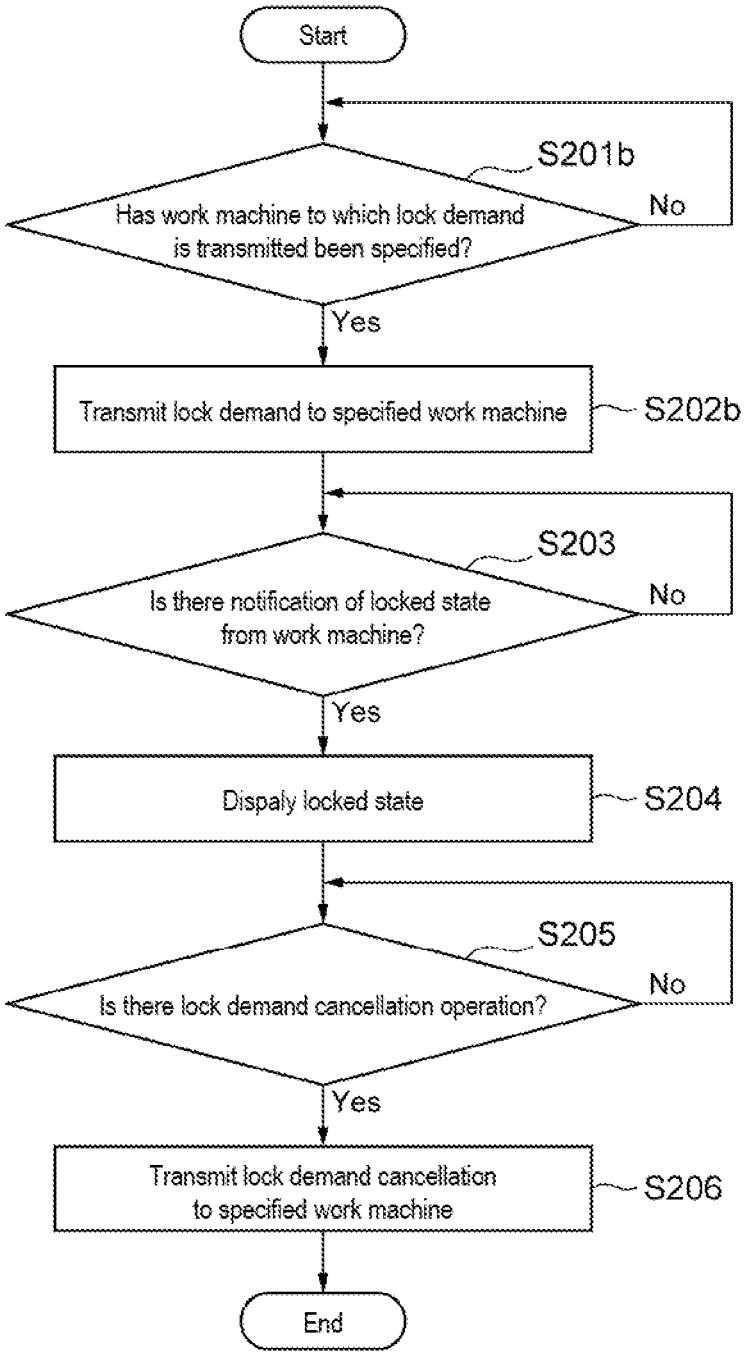
FIG. 11 is a control flow chart of a control unit of a communication terminal according to the fourth embodiment.

FIG. 11 is a control flow chart of the control unit of the communication terminal according to the fourth embodiment of the present invention.

In step S201*b*, it is determined whether the work machine 1 to which a lock demand to lock the lock mechanism 14 is transmitted has been specified using the specifying device 37. If the work machine 1 to which a lock demand to lock the lock mechanism 14 is transmitted has been specified, in step S202*b*, a lock demand to lock the lock mechanism 14 will be transmitted from the transmitting unit 33 to the specified work machine 1 (or the communication device 20 thereof).

(Advantageous Effects)

As described above, in the control system for a work machine of the fourth embodiment, the communication terminal 30 includes the specifying device 37 that is able to specify, from a plurality of work machines 1, a work machine 1 to which the lock demand signal is transmitted.

According to the above-described control system for a work machine of the fourth embodiment, on the worksite where the plurality of work machines 1 operate, since it is possible to specify the work machine 1 that the worker wishes to approach and then transmit a lock demand, the work machines 1 except the work machine 1 that the worker wishes to approach can continue to operate without being locked.

In the above-described control systems for a work machine of the first to fourth embodiments, a detailed description has been given of the case of locking the work implement as a work unit performing various works to disable operation thereof or unlocking the same. However, it is needless to mention in detail that the control system for a work machine of the above embodiments may be applicable also, for example, when locking or unlocking the lower traveling body 2 performing a traveling operation by driving a traveling motor configured by a hydraulic actuator and the upper turning body 3 performing a turning operation by driving a turning motor configured by a hydraulic actuator.

Although the above-described control systems for a work machine of the first to fourth embodiments are mounted on the work machine 1, the control system for a work machine of the present invention is not limited to the control system for a work machine mounted on the work machine 1.

Although the lock mechanism 14 of the work machine 1 is operated by an operator in the above-described control systems for a work machine of the first to fourth embodiments, the work machine 1 may be an automated machine or an unmanned machine where the operation of the lock mechanism 14 is controllably performed.

Although a worker transmits a lock demand in the above-described control systems for a work machine of the first to fourth embodiments, the lock demand may be controllably transmitted from a different machine or system.

It should be noted that the present invention is not limited to the above embodiments and includes a variety of modifications. The above embodiments have been described in detail to clearly illustrate the present invention, and the present invention need not include all of the configurations described in the embodiments.

Some or all of the aforementioned functions of the controller of the embodiments may be implemented as hardware by designing them into an integrated circuit, for example. Alternatively, each of the functions may be implemented as software such that a processor analyzes and executes a program that implements each function. Information such as the program that implements each function, tables, and files may be stored in a recording device such as a hard disk, or a SSD (Solid State Drive) or a recording medium such as an IC card, an SD card, or a DVD, other than the storage unit in the controller.

REFERENCE SIGNS LIST

1 Work machine
2 Lower traveling body (work unit)
3 Upper turning body (work unit)
4 Boom
5 Arm
6 Bucket
7 Work implement (work unit)
8 Cab
10 Locking device
11 Lock lever
12 Lock switch
13 Lock controller
14 Lock mechanism
20 Communication device
21 Communication control unit
22 Receiving unit
23 Transmitting unit
24 Display device (received information display device)
25 Input device
30 Communication terminal
31 Control unit
32 Receiving unit
33 Transmitting unit
34 Input device
35 Recording unit
36 Display device (notified information display device)
37 Specifying device
40 Communication network

The invention claimed is:

1. A control system for a work machine comprising:

a work machine including a work unit, a lock mechanism that locks the work unit to disable operation thereof, a lock switch that is switchable by operation of a lock lever, a lock controller that controls the lock mechanism based on a signal received from the lock switch, and a communication device; and a communication terminal that is able to communicate with the communication device of the work machine, wherein the lock controller, in a case receiving a lock demand signal for demanding a locked state of the lock mechanism from the communication terminal, controls the lock mechanism so as not to be released from a locked state and maintains the locked state of the lock mechanism until a lock demand cancellation signal for cancelling the lock demand signal is received from the communication terminal even if a signal indicating an unlocked state is received from the lock switch, in a case receiving a signal indicating an unlocked state from the lock switch, controls the lock mechanism to maintain the unlocked state until a signal indicating a locked state is received from the lock switch even if a lock demand signal for demanding a locked state of the lock mechanism is received from the communication terminal, and in a case receiving the lock demand cancellation signal for canceling the lock demand signal for the lock mechanism from the communication terminal, controls the lock mechanism so as to be released from the locked state when a signal indicating an unlocked state is received from the lock switch.

2. The control system for a work machine according to claim 1, wherein:

when the lock controller receives the lock demand signal from the communication terminal and the lock mechanism is in a locked state, the lock controller notifies the locked state to the communication terminal that has transmitted the lock demand signal via the communication device, and the communication terminal includes a notified information display device that displays information notified from the lock controller.

3. The control system for a work machine according to claim 1, wherein the work machine includes a received information display device that is able to display that the lock demand signal has been received from the communication terminal.

4. The control system for a work machine according to claim 3, wherein the control system comprises an input device that specifies the communication terminal having transmitted the lock demand signal, and has a function of notifying a request for canceling the lock demand signal to the communication terminal that has been specified by the input device.

5. The control system for a work machine according to claim 1, wherein the communication terminal includes a specifying device that is able to specify, from a plurality of work machines, a work machine to which the lock demand signal is transmitted.

* * * * *